United States Patent [19]

Muscanelli

[11] Patent Number: 4,798,286

[45] Date of Patent: Jan. 17, 1989

[54] BOTTLE HOLDER

[76] Inventor: Peter R. Muscanelli, 238 Cherry St., Schenectady, N.Y. 12306

[21] Appl. No.: 88,906

[22] Filed: Aug. 24, 1987

[51] Int. Cl.[4] ..... B65D 71/00

[52] U.S. Cl. ..... 206/150; 206/151; 294/87.2

[58] Field of Search ..... 206/150, 151, 158, 162, 206/168, 194, 199, 201; 294/87.2

[56] References Cited

U.S. PATENT DOCUMENTS 2,964,348 12/1960 Ingham ..... 206/162 X
4,022,363 5/1977 Eliassen ..... 206/199 X
4,651,873 3/1987 Stolcenberg et al. ..... 206/199 X
4,664,255 5/1987 Griffith ..... 206/427 X

*Primary Examiner*—Jimmy G. Foster
*Attorney, Agent, or Firm*—Brumbaugh, Graves, Donohue & Raymond

[57] ABSTRACT

A bottle holder in the form of a strap of plastic material adapted to be supported at one end and having an enlarged opening in the strap for receiving the neck of the bottle and a longitudinal slot in the strap communicating with the enlarged opening for supporting the bottles in generally perpendicular relation to the plane of the strap.

3 Claims, 1 Drawing Sheet

BOTTLE HOLDER

BACKGROUND OF THE INVENTION

This invention relates to bottle holders and, more particularly, to a bottle holder for supporting a plurality of empty bottles and carrying them to obtain the return deposit.

The bottle holder of the present invention includes a strap of plastic material adapted to be supported at one end. The strap contains at least one longitudinal slot for receiving the necks of the bottles and supporting the bottles in generally perpendicular relation to the strap. The necks of the bottles are inserted in an enlarged opening in the slot, and the neck of the bottle is then displaced into a narrower portion of the slot to grip the neck tightly and support the bottle from the strap. The slot is of sufficient length to accommodate a plurality of bottles so that they can be accumulated and carried by the strap to obtain the return deposit.

In a preferred embodiment of the bottle holder of the present invention, the strap is formed at one end with a transverse opening which can be used as a handle to carry the bottle holder with the empty bottles or to hang the bottle carrier from a suitable support while the empty bottles are accumulated on the strap. Moreover, the slot is preferably provided with a plurality of spaced-apart neck-locating openings to space the bottles relative to the slot in the strap, the neck-locating openings being connected by narrow portions of the slot.

For a more complete understanding of the present invention, reference can be made to the detailed description which follows and to the accompanying drawing.

THE DRAWING

FIG. 1 is a front elevational view of the bottle holder of the present invention; and FIG. 2 is a side view of the bottle holder shown in FIG. 1 with a plurality of bottles supported therefrom.

DETAILED DESCRIPTION OF THE INVENTION

Figure 1:
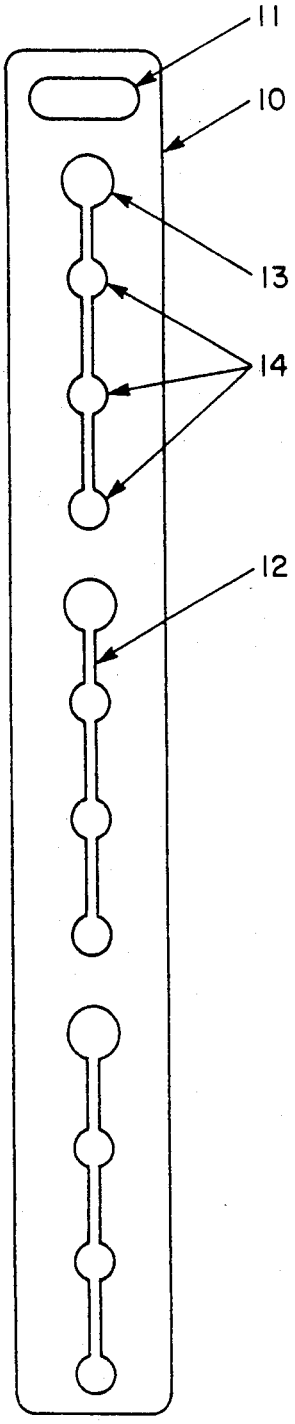
Figure 2:
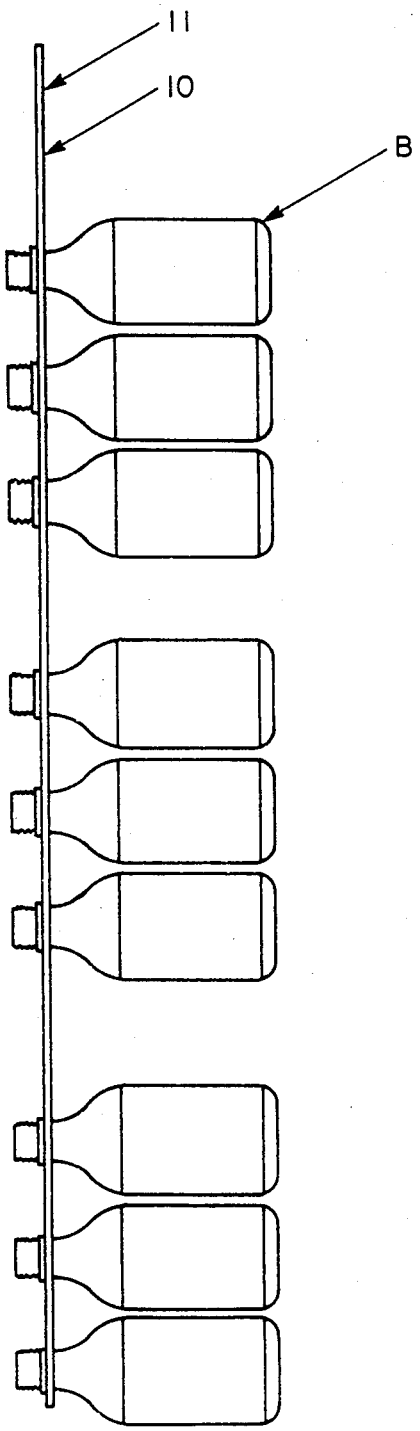

The bottle holder of the present invention includes a long strap 10 of plastic material. The strap 10 has a transverse opening 11 at the upper end which serves as a handle to facilitate carrying the bottle holder. It also permits the bottle holder to be mounted on an overhead support while the empty bottles are accumulated along the strap.

The strap contains a plurality of longitudinal slots 12, each having an enlarged opening 13 at the upper end for receiving the neck of a bottle B which is then displaced downwardly to force it into the narrower slot to grip the neck tightly and support it from the strap. Each slot is preferably provided with a plurality of spaced-apart neck-locating openings 14 to space the bottles relative to the slot in the strap. The plastic material is sufficiently rigid to support the bottles and, nevertheless, sufficiently flexible to permit the slots to expand so that the neck of the bottle can be easily displaced through the narrow portion of the slot to the lowermost empty neck-locating opening.

The empty bottles can be mounted on the bottle holder as they are used and stored until they are to be returned for deposit. The bottle holder with a plurality of empty bottles can be readily carried to return them for the collection of the deposit. The bottles can be easily removed from the bottle holder, and the bottle holder can be reused for the collection of another group of empty bottles. Moreover, it can be used, if it has the necessary strength and rigidity, to carry home full bottles.

The invention has been shown in a single preferred form and by way of example, and many modifications and variations can be made therein within the spirit of the invention. The invention, therefore, is not intended to be limited to any specific form or embodiment except insofar as such limitations are expressly set forth in the claims.

I claim:

1. A bottle holder comprising a long, flat strap made of plastic material of uniform thickness and having an upper end from which the strap is adapted to be supported, a handle opening in the upper end of the strap for carrying the bottle holder or suspending it from a support, a longitudinal slot in the strap for receiving the necks of a plurality of bottles and supporting the plurality of bottles in a row, one above the other, in generally perpendicular relation to the plane of the strap and an enlarged opening slightly wider than the slot and the neck of the bottle to be supported, said opening being spaced beneath the handle opening and the upper end of the slot and being in open communication with the upper end of the slot for the insertion of the neck of a bottle, which is then displaced downwardly and guided into the narrow portion of the slot to grip the neck tightly and support it from the strap.

2. A bottle holder comprising a long strap having an upper end from which the strap is adapted to be supported, a longitudinal slot in the strap for receiving the necks of a plurality of bottles and supporting the plurality of bottles in a row, one above the other, in generally perpendicular relation to the plane of the strap, an enlarged opening communicating with the upper end of the slot for the insertion of the neck of a bottle, which is then displaced downwardly into the narrower portion of the slot to grip the neck tightly and support it from the strap and spaced-apart neck locating-openings in the slot separated by narrow portions of the slot to position the bottles and space them one above the other.

3. A bottle holder as set forth in claim 2 in which the enlarged opening communicates with the upper end of the slot and in which the bottle neck is displaced downwardly within the slot to the lowermost empty neck-locating openings.

* * * * *